United States Patent [19]

Brown

[11] 4,240,635

[45] Dec. 23, 1980

[54] SLOT MACHINE DEVICE

[76] Inventor: Harry Brown, 2430 Atlantic Ave., Atlantic City, N.J. 08401

[21] Appl. No.: 19,303

[22] Filed: Mar. 9, 1979

[51] Int. Cl.[3] ..... A63F 5/04

[52] U.S. Cl. ..... 273/138 A; 194/DIG. 11; 194/1 R

[58] Field of Search ..... 194/1 R, 1 N, 2, 10, 194/DIG. 11; 273/138 R, 138 A, 143 R

[56] References Cited

U.S. PATENT DOCUMENTS

| | | | |
|---|---|---|---|
| 3,929,338 | 12/1975 | Busch | 273/138 A |
| 4,095,795 | 6/1978 | Saxton et al. | 273/143 R |
| 4,101,129 | 7/1978 | Cox | 273/143 R |

OTHER PUBLICATIONS

"Games machine", D. Burn, Practical Electronics, 12-76, pp. 969-975.

"Timer Pulses Coasting to a Stop", Ideas for Design, William Kraeugel; 3-77, p. 78.

Scott, Waller M., "Electronic Casino", Radio-Electronics, 1974.

*Primary Examiner*—Joseph J. Rolla

*Attorney, Agent, or Firm*—Robert K. Youtie

[57] ABSTRACT

A slot machine device of substantially electronic construction including a changeable display provided by activatable matrices, a pseudo random number generator for producing stored information on demand in an apparently random manner, and a microprocessor connected between the number generator and display for effective cooperation therebetween to produce an apparently randomly selected character display.

4 Claims, 4 Drawing Figures

INTERNAL TIMING SEQUENCES

SLOT MACHINE DEVICE

BACKGROUND OF THE INVENTION

As is well known to those versed in slot machine construction and operation, those presently manufactured and employed are substantially mechanical and essentially the same as have been produced for many years, and are therefore subject to the shortcomings and defects of mechanical devices, for example being rapidly subject to wear, physical deterioration and consequent reduction in performance, and even in optimum condition being relatively slow in operation as involving the movement and inertial forces of mechanical elements.

While there have been proposals to partially electrify slot machine devices and the like, as by incorporation of solid state electronics, such proposals have been generally unsatisfactory and have not found acceptance. Applicant is aware of prior art including U.S. Pat. Nos. 2,998,252; 3,164,918; 3,269,503; 3,606,337; 3,704,890; 3,834,712; 3,913,922; 4,051,939; and 4,071,246.

SUMMARY OF THE INVENTION

Accordingly, it is an important object of the present invention to provide a slot machine device which is substantially completely fabricated of solid state electronics to achieve the reliability, high speed performance and economy thereof.

It is a more particular object of the present invention to provide a slot machine type of amusement device wherein a plurality of apparently random symbols are presented by solid state electronic imaging devices to substantially reduce initial and maintenance costs, permit of more plays and consequent income per unit of time, all while accurately simulating the apparent operation of a conventional mechanical slot machine so as to be readily substitutable therefor.

In addition to the foregoing, the rate of payouts, being the ratio of payout to payin, is selectively adjustable and may be higher than with mechanical apparatus to favor the customer without penalizing the owner.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
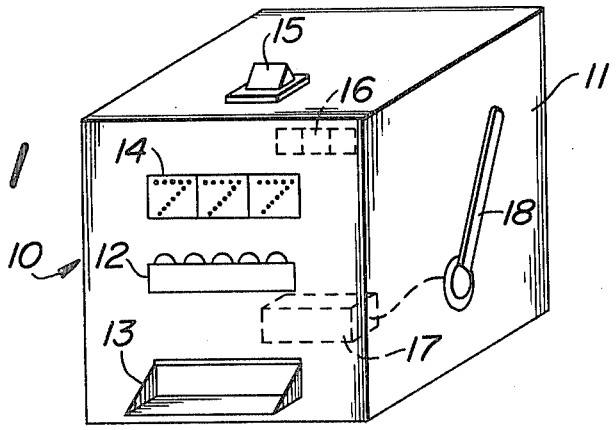
FIG. 1 is a front perspective view showing a slot machine constructed in accordance with the teachings of the present invention.

Referring now more particularly to the drawings, and specifically to FIG. 1 thereof, a slot machine type amusement device is there generally designated 10, and includes an outer housing, casing or enclosure 11 provided on the front wall thereof with a coin insertion means or slot 12 adapted to receive a selected range of coins, and also provided with a coin payout or dispensing means 13. At convenient height, the front wall of the housing 11 may be provided with changeable character or symbol display means 14, which may include display means for presenting a plurality of graphic representations, symbols or characters.

Exteriorly of the housing 11, as on the top thereof may be provided a signal or indicator 15, say indicating a winning play, and also carried by the housing may be changeable indicia, such as numerical presentation at 16 indicating the amount or number of coins in a payout.

Internally of the casing 11 is a microprocessor, generally designated 17 which electronically cooperates with the coin receiver 12, coin dispenser 13, display or imaging means 14 and indicators 15 and 16 to effect the desired slot machine operation. An external manually actuable element or handle 18 is provided on the housing 11 and electrically connected, as by a start switch, to the microprocessor 17 to initiate the slot machine operation.

Figure 4:
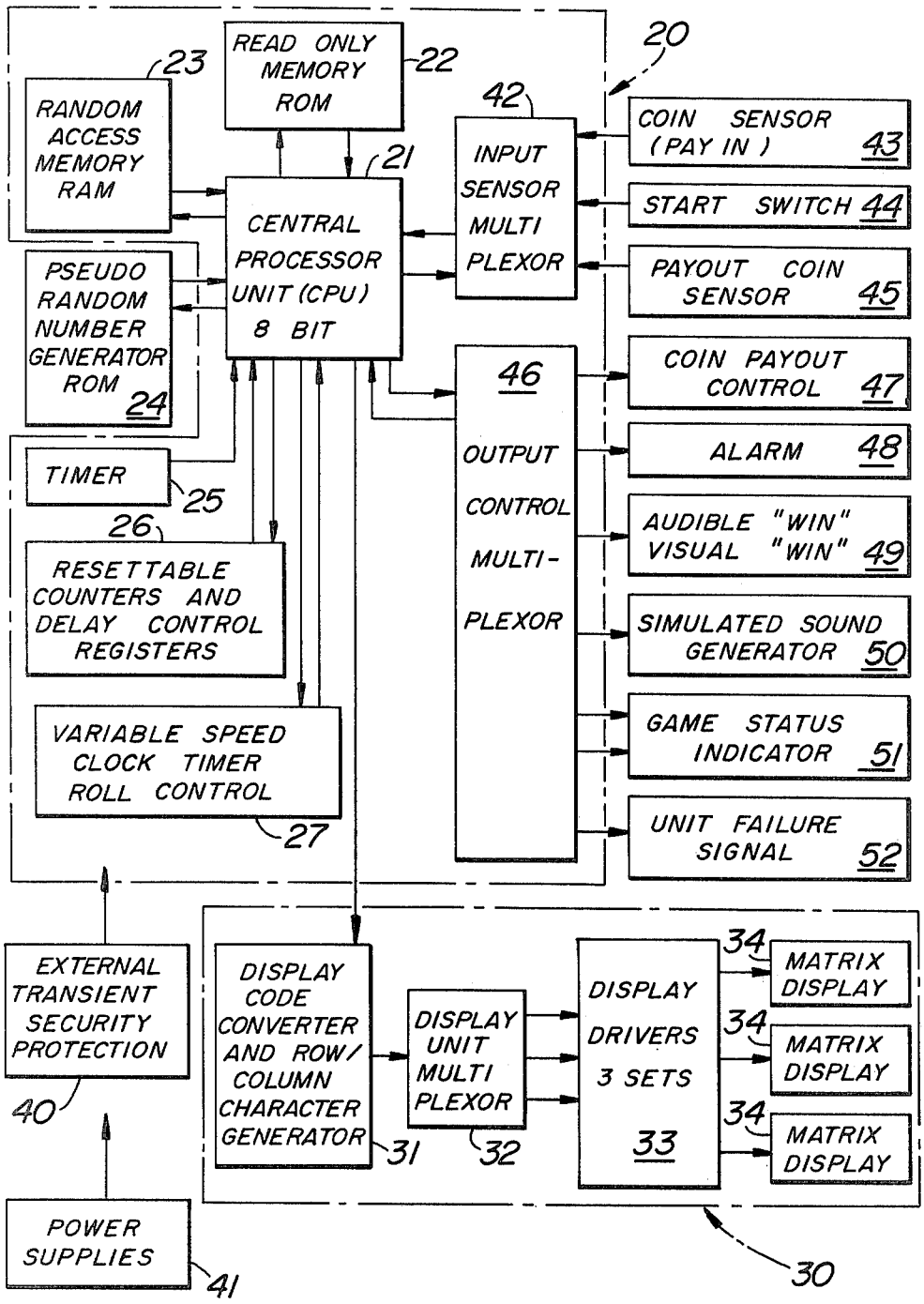
FIG. 4 is a diagrammatic representation of the electronic circuitry of the instant slot machine device.

Referring now to FIG. 4, a microprocessor is there generally designated 20, and includes a central processor unit 21 which may be a standard integrated circuit internally programmed during manufacture to follow a predetermined set of instructions. It may act on internally and externally stored instructions, and electronically control (starting, stopping, and accounting) by output electronic signals, a number of electronic devices based on the instructions of the central processor unit, instructions from external memories, and on the status of devices which can send electrical status signals to the central processor unit.

The central processor unit is capable of addressing at least 256 devices by binary electronic signals, and can select a set of actions to be followed based on a set of rules (algorithm) stored in itself and in adjacent memories which store the sets of conditions, and actions desired, and the device activity intended if the known set of conditions are achieved.

The central processor unit acts according to internal programs provided by the manufacturer as an instruction set, and also written to utilize the instruction set as a simple language to innumerate the steps and conditions necessary for it to control devices and process status information. Internally within the central processor unit, the manufacturer has provided sufficient registers, counters, logic units, memories, buffers and interface circuits, all within the single integrated circuit, so as to be able to function when the proper power and signals are applied.

A read only memory (ROM) 22 is a commercially available integrated circuit containing no stored information when supplied by the manufacturer, and into it are placed a series of digitally coded words in a sequence such that by keeping track of the addresses in the memory the words will be sent to the central processor unit (CPU) as a series of electronic signals. The information stored in the ROM is not alterable and is a non-destructible set of instructions and data containing information on payoff rates as a function of the number of coins played and as a function of special number sets. A set of instructions placed into the ROM also mimics a normal set of sequences during play and verifies certain actions before others are allowed to occur. The ROM is supplied by the manufacturer with internal interface and timing elements so that it can communicate with the CPU, the speed and access time of instructions and data being, in conjunction with the CPU, typically 0.5 to 2.0 microseconds per instruction. The ROM also contains the display image code sequences, and provides them as a series of code words through the CPU to a display means, as will appear hereinafter. The central processor may be an 8 bit unit, and the ROM can store at least several thousand 8 bit words.

Also, part of the microprocessor 20 and connected to the CPU is a random access memory 23 (RAM), which is a commercially available integrated circuit device that temporarily stores binary information as words in a destructible memory. It is the storage place for the status information that the CPU is acting on or will act on. The CPU places the information in the RAM and then recalls it at a later time for use or action determination. The RAM speed of operation is compatible with the CPU, and the CPU remembers in its own internal memories where it has placed the information it will later request back. The RAM contains, within the integrated circuit, suitable interface and control logic to address properly the memory locations, and is selected for compatibility with the CPU.

Externally supporting the CPU is a pseudo-random number generator 24, which is a commercial available ROM integrated circuit programmed to output a stored word on demand from a list of words in its memory. The word is chosen on the basis of a set of rules (algorithm) which utilize the timing control from the CPU, counters and timers internal to the number generator and supplied as part of the integrated circuit and the number generator program. Such programs are available commercially fully developed to provide processor controlled degrees of pseudo-randomness, and are also sold commercially already integrated with the random number generator. The degree of pseudo-randomness for the instant application may be preset to provide a fixed pay-in:pay-out ratio over a minimum of 10,000 pay-in units.

The number generator ROM 24, as provided by the manufacturer, contains the interface and input/output control logic to connect directly to the CPU. A maximum of 16,000 8 bit words is typical of commercially available products adapted to satisfy this requirement, and speed of operation is not critical.

A timer or timers 25, which may be commercially available signal generators on a single integrated circuit, are necessary for accurate concurrent and sequential operation of all the memories and the CPU. Such timer devices are connected to the central processor unit and may be frequency controlled to insure clocked operation of all data and program word transfers, as well as immunity from external noise. Such standard timers are specifically adapted to interface with a CPU and contain all the shapers, oscillators, logic and drivers internal to the integrated circuit.

Also connected to the CPU are resettable counters and delay control registers 26, which are binary registers, buffers and logic bit store elements, as are commercially available. The counters are 8 and 16 bit units that are incremented by the CPU and can be reset by the CPU. The counters serve to keep a count of plays, coins, payout, and the number of wins. The delay control registers contain sets of fixed counts which are decremented by the CPU during a single play action to effectively delay the various actions to approximate the delays in a mechanical slot machine device.

Additionally connected to the CPU is a variable speed clock timer-roll control 27. This is a register which is a preset up-down counter of variable modulus, and is used to modulate or vary the transfer rate of character code from the CPU to a display means.

More specifically, a display means is generally designated 30, and is connected to receive output from CPU. The display means may include a display code converter and row/column character generator 31 which receives the CPU output and is, in turn, connected to a display unit multiplexor 32. The multiplexor 32 may be 3-channeled for connection to 3 sets of display drivers, as at 33, which are respectively connected to 3 matrix displays 34. The matrix displays may be a plurality of separately activatable display elements, such as light emitting diodes (L.E.D.) arranged in ranks and files, or rows and columns, and being energizable to visually present a desired symbol or character.

The display code converter and row/column generator is a commercially available decoder-encoder integrated circuit that accepts a binary code word and converts it to an image in a row and column matrix, such as a matrix array of light emitting diodes. The image may be caused to "roll" or move on the matrix, as by moving each energized row of the displayed character to the next upper row of the matrix, the illuminated L.E.D.'s of the bottom row of the display matrix moving to illuminate the corresponding L.E.D.'s of the next adjacent row of the display matrix, and so forth. The character generator 31 keeps track by internal counters of the character row that is currently displayed on the bottom display matrix row, and this is done for the three matrix displays at a speed fast enough to accept successive character codes and perform the decoding and encoding into image dots for the three displays and send the row matrix dot configurations to the multiplexor 32. The multiplexor is also commercially available, and advantageously a high speed serial binary code multiplexor. It accepts a series of bit dot signals and sends the first series to one display 34, the second series to another display 34, the third series to still another display 34, the fourth series to the first mentioned display 34, and so on. This occurs at a rate fast enough so that each dot in all rows on the three displays can be illuminated at least 100 times a second under a test condition of all matrix dots illuminated.

Thus, the characters imaged on the matrix displays 34 are caused to move or roll; and by the variable speed clock timer-roll control the speed of image movement or roll is gradually reduced to simulate that of decelerating mechanical wheels.

While not critical to the invention, external transient security protection is provided at 40 and will assure uninterrupted and secure operation of the all-electronic device by using radio frequency filtering, phase lock loop circuitry and other protective devices to prevent electronic interference.

Power supplies are indicated at 41 and may be standard commercial units operating from available electrical supply to provide required DC voltages. A backup battery supply recharged from AC mains, is included to maintain the RAM, CPU and external registers data contents in case of power failure and equipment relocation.

An input sensor multiplexor 42 is a commercially available multiplexing input integrated circuit. Under CPU control, individual input interfaces are enabled to allow a single signal, such as a switch contact or photocell output, to be routed through the multiplexor, as a digital binary status, to the CPU. The multiplexor may be at least a 4 input, externally clocked, buffered, gated input device manufactured as a standard logic component.

A coin sensor 43, sensing coin input or payin, may be electromechanical, photo-optical, or other, and signals the CPU through the input sensor.

A start switch 44 is also connected to the input sensor multiplexor 42 and may be a buffered, one-shot multivibrator actuated by suitable optical, magnetic or other means. The start switch is manually actuated by the hand lever 18, and is enabled by the sensing, by coin sensor 43, of a received coin.

A payout coin sensor 45 may be identical to pay-in coin sensor 43, but located to sense the payout or dispensing of coins, providing suitable signal means to the central processor unit through the input sensor multiplexor.

An output control multiplexor 46 is electrically connected to the CPU and may be a commercially available multi-channel output controller device, manufactured as a single integrated circuit. Internal to the output controller multiplexor is an input decoder, clock controller, logic switches, and buffered signal drivers to interface with external relays, indicators, solenoids or other electronically triggerable devices.

Connected to the output control multiplexor, for actuation thereby, is a coin payout control 47, which may be an electromechanical release mechanism for dispensing coins under computer control as monitored by payout coin sensor 45.

Also connected to receive output from the output control multiplexor may be various signal, indicator or alarm means, such as an alarm 48, say audible or visual which may operate responsive to malfunctioning of the machine or operator influenced activity, such as mechanical shock or electrical interference.

Other output indicators are standard visual and audible indicators 49 to indicate "win" conditions, as well as a sound or tone generator 50 which may produce sounds simulating mechanical machine operation, such as that of rotating gears, wheels, and dials.

Also connected to the output control multiplexor may be desired game status indicators 51, as well as a unit failure signal or indicator 52.

Figure 3:
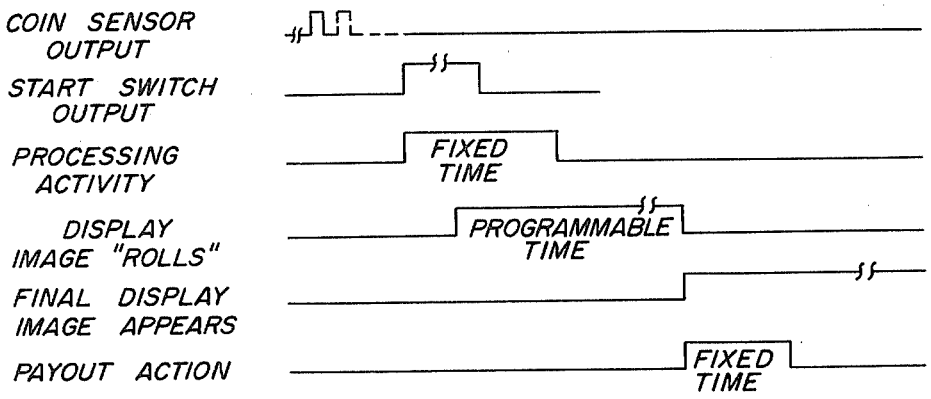
FIG. 3 is a graphic representation of the sequence of timed actions occurring in operation of the instant device.

The sequence of operation may be seen in FIG. 3, the coin sensor 43 producing a signal upon coin sensing to enable the start switch 44 to be operated. Operational closing of the start switch starts processing activity which proceeds for a fixed period, during which the display image is caused to move or roll as presented by the matrix displays 34. As controlled by the CPU and through the display code converter, the displayed image stops moving, the stopping occurring sequentially at the several displays, upon which payout action occurs, all as shown in FIG. 3.

More specifically, after coin sensing has enabled start switch and the latter manually actuated, a pseudo random number is sent from number generator to CPU and the CPU sends display codes to the character generator. The display images start to roll and a delay timer starts counting. Simulated sound may be generated. After a fixed delay, approximately 2-3 seconds, one display starts to slow the rolling rate and stops, after which the second and third displays slow and stop. The CPU has stopped the display images at predetermined images so that the payout is started, if justified, as soon as the last display image stops rolling.

Various indicator lights may indicate operation or status of operation.

Upon payoff, the coins are released by coin payout control 47, the coin release being monitored by payout coin sensor 45. When proper count is reached, the coin release action is stopped and the game action is stopped. All circuits are reset as necessary, the display image remains stationary and the indicator lights indicate the game is over.

Figure 2:
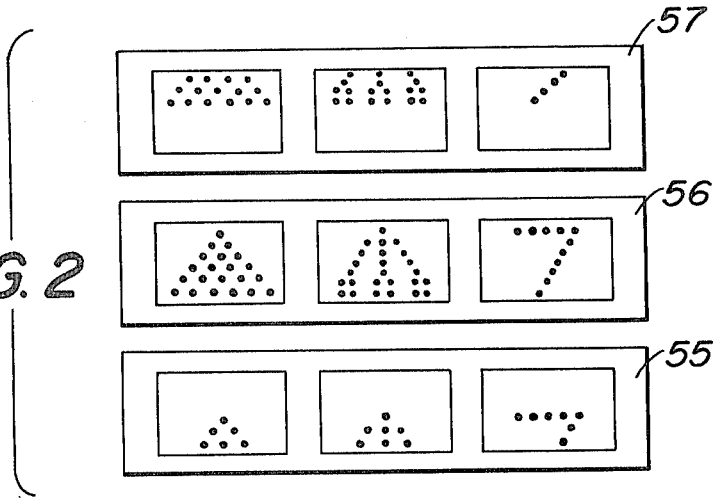
FIG. 2 is a series of views of a display device of the present invention, illustrating the display at spaced intervals of time.

The display image rolling action is best shown in FIG. 2, the initial phase being shown at 55 as illustrating three lines of symbols on the matrix displays, while the slightly later stage of display is shown in 56 and illustrates four additional lines of the symbols or characters, which are complete. The still later condition of displays shown at 57 illustrate the symbols to have progressed about another three or four lines for apparent movement out of the image area.

From the foregoing, it will be seen that the present invention provides a substantially completely solid state slot machine or like amusement device which is relatively simple in construction and operation, adapted to be assembled substantially from commercially available electronic integrated circuits, and which is well adapted to fully accomplish its intended objects Although the present invention has been described in some detail by way of illustration and example for purposes of clarity of understanding, it is understood that certain changes and modifications may be made within the spirit of the invention.

What is claimed is:

1. A slot machine device comprising changeable display means, a pseudo random number generator, a microprocessor connected between the number generator and display means for accessing former and controlling the latter to present an apparently randomly selected character, said display means comprising a matrix of activatable display elements arranged in rows and columns, character generator means connected between said microprocessor and display means and controlling activation of said display elements to present a character and to change the activated display elements to present the appearance of a moving character, and a variable speed timer connected to said microprocessor to modify the transfer rate of randomly selected character input signals from the microprocessor to said display element to simulate a decelerating mechanical wheel.

2. A slot machine device according to claim 1, said microprocessor comprising a central processor unit connected to said display means, a read only memory connected to said central processor unit for imparting permanently stored information to the central processor unit, and a random access member connected to said central processor unit for imparting temporarily stored information to the central processor unit, for operating said coin dispenser control means responsive to the interaction of signals from said number generator on information stored in said read only and random access memories.

3. A slot machine device according to claim 2, in combination with timer means connected to said central processor unit for controlling concurrent and sequential operation of said memories and central processor unit, and resettable counters and delay control registers connected to said central processor unit for counting and delaying the various operations.

4. A slot machine device according to claim 3, in combination with indicator means for indicating various slot machine operations.

* * * * *